US006878103B2

(12) United States Patent
Ackermann

(10) Patent No.: US 6,878,103 B2
(45) Date of Patent: Apr. 12, 2005

(54) CONTROLLING CUTS IN AN INNER LINER FOR A GROUP OF CIGARETTES

(75) Inventor: Gunter Ackermann, Bischofsgrun (DE)

(73) Assignee: R. J. Reynolds Tobacco Company, Winston-Salem, NC (US)

( * ) Notice: Subject to any disclaimer, the term of this patent is extended or adjusted under 35 U.S.C. 154(b) by 27 days.

(21) Appl. No.: 10/329,875

(22) Filed: Dec. 26, 2002

(65) Prior Publication Data

US 2003/0123068 A1 Jul. 3, 2003

(30) Foreign Application Priority Data

Dec. 27, 2001 (DE) ..... 201 20 977 U

(51) Int. Cl.[7] ..... B31B 1/00

(52) U.S. Cl. ..... 493/13; 493/14; 493/16; 493/18

(58) Field of Search ..... 493/13, 14, 15, 493/16, 17, 18; 250/548, 202

(56) References Cited

U.S. PATENT DOCUMENTS 4,137,528 A * 1/1979 Traise ..... 340/675
4,682,038 A * 7/1987 Focke ..... 250/548
4,813,288 A * 3/1989 Gamberini ..... 73/865.8
4,899,765 A 2/1990 Davis et al.
5,664,026 A * 9/1997 Neri et al. ..... 382/143
5,674,347 A * 10/1997 Edwards et al. ..... 156/351
5,800,325 A * 9/1998 Wilkes ..... 493/22
5,807,222 A * 9/1998 Totani ..... 493/22
5,970,682 A * 10/1999 Focke et al. ..... 53/53
6,253,817 B1 * 7/2001 Edwards et al. ..... 156/351
6,264,591 B1 * 7/2001 Keen et al. ..... 493/4
6,726,612 B1 * 4/2004 Bodolay ..... 493/213

FOREIGN PATENT DOCUMENTS

| | | |
|---|---|---|
| DE | 3341539 A1 | 5/1985 |
| DE | 3700928 A1 | 7/1987 |
| DE | 196 07 215 A1 | 8/1997 |
| DE | 197 43 984 A1 | 4/1999 |
| DE | 198 59 949 A1 | 6/2000 |
| EP | 0 677 444 A1 | 4/1995 |

* cited by examiner

*Primary Examiner*—Sameh H. Tawfik
(74) *Attorney, Agent, or Firm*—John F. Salazar; Middleton Reutlinger

(57) ABSTRACT

A device for controlling at least one cut in an inner liner for a group of cigarettes in a cigarette packaging machine comprises at least one optical detector consisting of a light source and a sensor.

3 Claims, 3 Drawing Sheets

CONTROLLING CUTS IN AN INNER LINER FOR A GROUP OF CIGARETTES

CROSS-REFERENCE TO PRIOR APPLICATIONS

This application claims priority to German Utility Model Application No. 201 20 977.2, filed on Dec. 27, 2001, which is incorporated herein by reference.

BACKGROUND OF THE INVENTION

The present relates to a device for controlling at least one cut in an inner liner for a group of cigarettes on a cigarette packaging machine.

When packaging cigarettes in flip-lid packets, the cigarettes are wrapped in an inner wrapping, the so-called inner liner, and the flip-lid packet is wrapped around said wrapped group of cigarettes by the packaging machine.

The inner liner can consist of printed paper, metallized paper or other suitable, strip-shaped materials. These materials are drawn off at the packaging machine from a bobbin and cut to the appropriate length. Before the inner liner is wrapped around the cigarettes, the inner liner is often subjected to impressing, printing or other processing. One of these possible processing steps is to deliberately cut into the inner liner to create desired separation points which allow the smoker, when opening the packet for the first time, to tear out a section of the inner liner in the area of this opening and thus reach the cigarettes.

If these cuts in the inner liner are not carried out properly, then access to the cigarettes is made more difficult and it is no longer possible to easily remove the packaging from around the cigarettes.

Hitherto, these cuts in the inner liner have not been controlled, rather it has only been established from test samples of finished cigarette packets that the inner liner has not been correctly cut. The machine then has to be re-adjusted and the cigarette packets having an incorrectly cut inner liner are disposed of and not released into the market.

Since several thousand defective cigarette packets are often manufactured until, by random sampling, a defective cigarette packet has been detected, a technique has been sought to verify on-line, i.e. while the cigarettes are packaged, that the cuts in the inner liner are correct.

SUMMARY OF THE INVENTION

The Invention is therefore based on the object of providing a device for controlling cuts In an inner liner, which on the one hand responds fast enough to be used on-line, and on the other reliably establishes that the cuts are correct.

The advantages achieved by the invention are based on the use of an optical detector, integrated into the conveying section for an inner liner in the packaging machine, comprising a light source and a sensor which is arranged on the conveying section of the inner liner and can detect both cuts running along the transport direction of an inner liner, which are thus present in the detection area for a long time, and cuts running perpendicular to the transport direction, which thus result in only a brief response of the optical detector.

In principle, such an optical detector can operate using reflection or transmission, a transmission detector being preferred since, as mentioned above, the inner liner is often metal-coated and thus has a certain reflective effect. This makes detecting a clear detection signal more difficult when using a reflective optical detector.

Since the inner liners which are transported past the optical detector are separated by a gap which the optical detector could identify as a cut without further measures, the detector or the sensor in the embodiment using a single detector is coupled to the conveying speed for transporting the inner liner. Thus, the optical detector can only respond when it is established, on the basis of the conveying speed, that an inner liner is actually being transported past the optical detector. Therefore, a cut is present when an inner liner is being transported past the detector, and not a gap between two inner liners, when the amount of light falling on the sensor changes significantly.

It is not important here whether the cuts in the inner liner run parallel or perpendicular to the transport direction, since both cases can be detected and indicated by coupling the sensor to the conveying speed of the inner liner.

It has proven expedient if, when an inner liner with an incorrect cut is ascertained, an indication signal is generated and an error message is outputted to the packaging line, such that for example said inner liner which has been ascertained as defective is removed from the production line and ejected as waste.

As an alternative to the described embodiment comprising a single optical detector, two optical detectors can also be used, arranged sequentially in the conveying direction of the inner liner and at a distance from each other. This distance is smaller than the length of the individual inner liner in the transport direction.

In this case, coupling to the conveying speed of the inner liner is no longer required, since a correct cut in the inner liner can be established when both optical detectors simultaneously respond, i.e. one optical detector establishes the presence of the inner liner and the other optical detector establishes the presence of a cut.

The two optical detectors therefore have to be arranged at a distance from each other, the distance being smaller than the length of the inner liner in the transport direction.

Also for avoiding detection errors, it is expedient if the two optical detectors are based on different detection principles, i.e. one operates using transmission and the other operates using reflection.

Particularly good results have been achieved in experiments on a cigarette packaging machine comprising three optical detectors which are arranged sequentially in the transport direction of the inner liner at a distance from each other such that the largest distance between two optical detectors is smaller than the length of the inner liner in the transport direction.

The middle optical detector then expediently operates using transmission, while the two outer ones operate using reflection.

In this case, an inner liner is judged to be "cut" if all three optical detectors output a signal.

In principle, it is possible for the central optical detector to constantly be in operation, or to only be switched on when the two outer optical detectors respond to the presence of the inner liner.

In this case, the position of the optical detectors relative to each other and the dimensions of the inner liner being transported by the detectors are crucial. This also enables the device to be easily adapted to changing packet formats and therefore also inner liner dimensions and to a changing position of the cuts by correspondingly adjusting the optical detectors in the conveying direction of the inner liner.

In all the embodiments, coupling to the conveying speed of the inner liner not only establishes the presence of a cut but also its correct length, and therefore rules out another source of error.

BRIEF DESCRIPTION OF THE DRAWINGS

In the following, the invention will be explained in more detail by way of example embodiments and by referring to the enclosed, schematic drawings, which show.

DETAILED DESCRIPTION OF THE INVENTION

Figure 1:
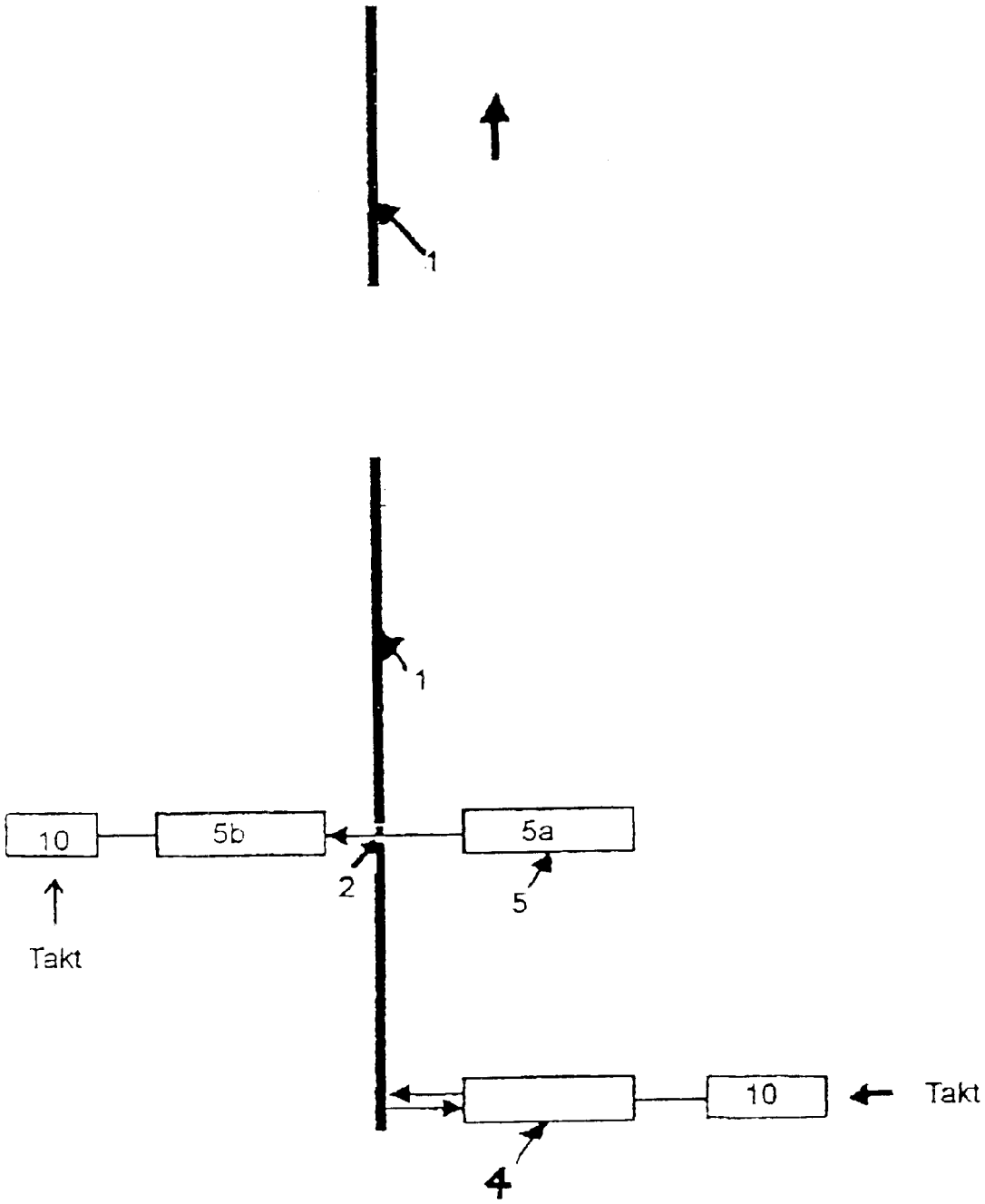
FIG. 1 a schematic representation of an inner liner with one or two optical detectors.

FIG. 1 shows two inner liners 1 which are transported in the direction of the arrow and supplied to a packaging machine (not shown). These inner liners 1 have, in accordance with the drawings, a certain distance from each other such that a gap is created between them. Each inner liner 1 must be provided with a cut 2.

In a first embodiment, a single optical detector 4 is arranged on the transport section of the inner liners 1, said detector operating using reflection, i.e. the optical detector 4 includes both a light-emitting diode and a sensor. The output of the optical detector 4 is connected to an evaluation unit 10 which contains information about the speed of the machine, in particular about the conveying speed for the inner liners 1.

The output signal of the sensor of the optical detector 4 then changes in increments as soon as the light emitted by the light-emitting diode is no longer reflected off the inner liner 1. This change represents either a gap between two consecutive inner liners 1 or a cut 2. Due to the coupling to the conveying speed of the inner liner 1 with the evaluation unit 10, the unit 10 can establish that, at the time the output signal of the sensor of the optical detector 4 jumps, the inner liner 1 is positioned next to the optical detector 4 and the sensor is not detecting a gap between two consecutive inner liners 1. Therefore, a correct cut in the inner liner 1 is established.

FIG. 1 also shows an embodiment using a single transmissive optical detector 5, i.e. the light-emitting diode 5*a* is situated on one side and the sensor 5*b* on the opposite side of the inner liner. At the time shown in FIG. 1, a cut 2 in the inner liner 1 is passing the optical detector 5 such that light emitted by the light-emitting diode 5*a* falls on the sensor 5*b* and the presence of a cut 2 can likewise be established, again in combination with the evaluation unit 10 which is supplied with the conveying speed of the inner liners 1.

Lastly, FIG. 1 can also be regarded as an embodiment comprising two optical detectors 4, 5, of which one operates using reflection and the other operates using transmission.

The distance between the two detectors 4, 5, as seen in the transport direction, is smaller than the length of the inner liners 1, such that if both detectors 4, 5 simultaneously respond, the presence of a correct cut 2 in the inner liner 1 can be deduced.

A coupling to the conveying speed of the inner liners 1 or of the machine can, however, also additionally be provided in this embodiment, for which an evaluation unit 10 is then likewise required which is connected to the sensor 5*b*.

Figure 2:
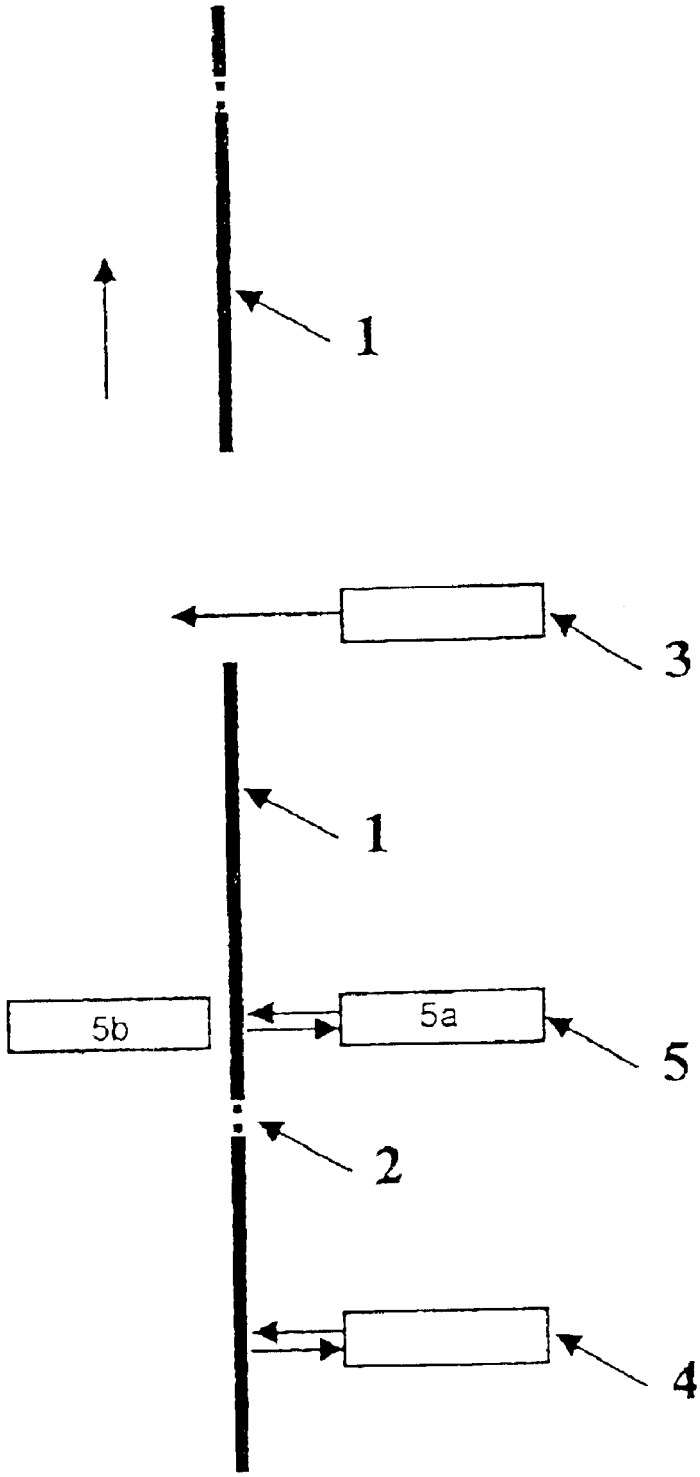
FIG. 2 a representation corresponding to FIG. 1, comprising three detectors.

FIG. 2 shows an embodiment comprising three optical detectors 3, 4 and 5, of which the central detector 5 operates using transmission, i.e. likewise comprises a light-emitting diode and a sensor 5*b* separated from it, while the two outer optical detectors 3 and 4 operate using reflection.

In accordance with FIG. 2, the upper optical detector 3 is situated precisely in intermediate space between two inner liners 1 running sequentially, and thus receives no signal. The optical detector 4, by contrast, does output a signal, since it lies opposite an inner liner 1 from which light is reflected. The optical detector 5 also receives no signal (or a signal below an adjustable threshold) from the sensor 5*b*, since it is situated at a portion of the inner liner having no cut 2. Since the optical detector 5 does not yet have a function at this time, it can in principle also be switched off.

Figure 3:
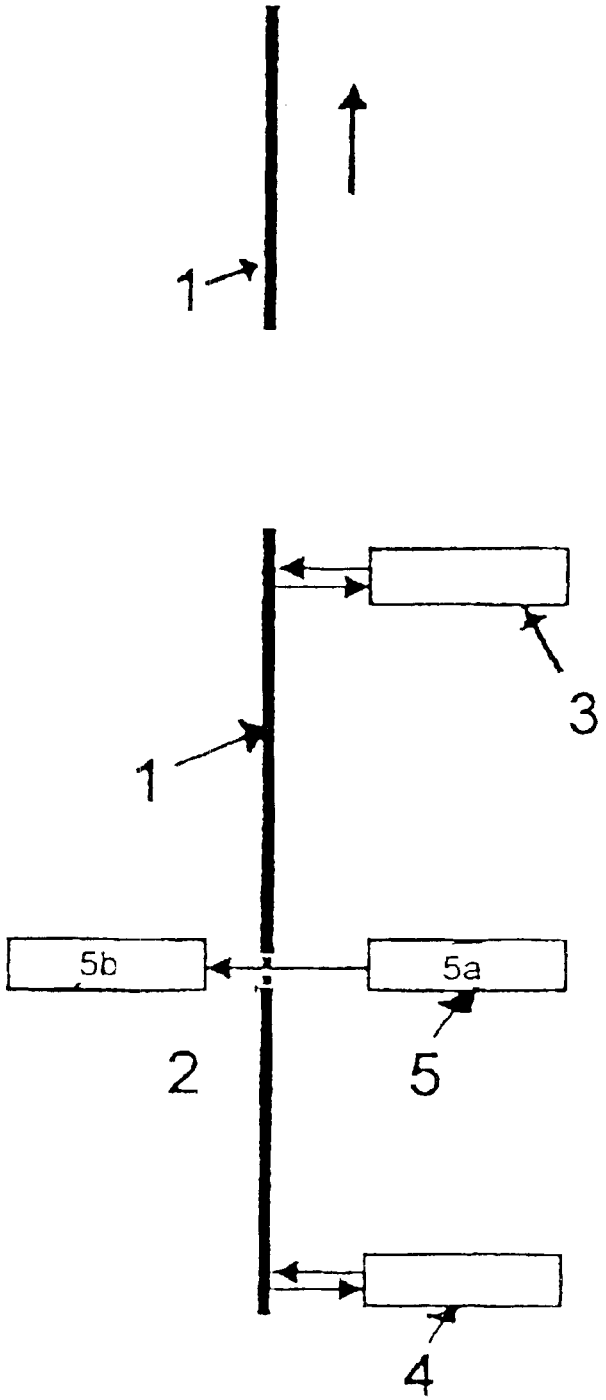
FIG. 3 a representation corresponding to FIG. 2, in the position in which the presence of a cut in the inner liner is established.

If the inner liners 1 move further in the direction of the arrow, as shown in FIG. 3, then the upper optical detector 3, which operates using reflection, also receives a signal, i.e. both the outer optical detectors 3 and 4 are now responding. If the optical detector 5 is operating by being switched on and off, then this would then have to be switched on.

As soon as the cut 2 in the inner liner 1 passes the optical detector 5, the light emitted by the light-emitting diode falls on the sensor 5*b*, the sensor 5*b* outputs a corresponding detection signal, and the cut 2 is detected as being correct.

If, however, the sensor 5*b* does not receive a signal during the time in which the two optical detectors 3 and 4 indicate the presence of the inner liners 1, then this generally means that the inner liner 1 does not contain a correct cut 2. In this case, an error message is outputted to the packaging machine and as appropriate this inner liner can be transported out of the conveying path.

In the embodiment comprising two optical detectors 4, 5 of FIG. 1 or three optical detectors 3, 4, 5 of FIG. 2, the position of the optical detectors relative to each other has to be adapted to the dimensions of the inner liners 1, such that the maximum distance of the optical detectors from each other, as seen in the transport direction of the inner liners 1, is smaller than the length of an inner liner 1 in this direction.

This also enables the device to be easily adapted to changing packet formats and therefore also dimensions of the inner liners 1 and changing positions of the cuts 2 without problems, by correspondingly adjusting the optical detectors 3, 4, 5 along the transport path of the inner liners 1, in order to satisfy the above condition.

In the embodiment comprising one optical detector or two optical detectors 4 and 5 (FIG. 1), the evaluation of the signal(s) is correlated with the conveying speed of the inner liners 1. This enables an evaluation of the presence of a cut 2 in desired areas in which an inner liner 1 passes each optical detector 4, 5.

By adapting more exactly to the transport speed of the inner liners 1 and by measuring with a correspondingly higher resolution, it is possible to establish not only the presence of a cut 2 but also whether the length of a cut 2 is correct, since if the conveying speed of the inner liner 1 is known and constant then the duration of a "cut signal" outputted by the sensor 5*b* represents a measure of the dimensions of the cut 2 in the transport direction.

What is claimed is:

1. A device for detecting cuts in an inner liner in a cigarette packaging machine, comprising:

a first, second and third optical detector, each of said optical detectors, having a light emitting source and a light detector;

said first, and third optical detector being separated by a maximum distance from each other which is less than the length of an inner liner for a group of cigarettes in a cigarette packaging machine; and wherein the second optical detector positioned between the first and third optical detectors;

wherein said first and third optical detector are reflective detectors and said second optical detector is a transmissive detector, said first and said second optical detector operably connected to an evaluation unit, said evaluation unit receiving a signal representing the conveying speed of said inner liner.

2. The device for detecting cuts in an inner liner of claim 1 wherein said second optical detector is positioned between said first and said third detector at a predetermined distance, said inner liner having a desired cut at said predetermined distance.

3. A device for detecting cuts in an inner liner in a cigarette packaging machine, comprising:

an inner liner having a formed cut at a predetermined position;

a first, second and third optical detector having a light source and a sensor;

said second optical detector being a transmissive detector and said first and third optical detector being reflective detectors;

said second optical detector positioned between said first and said third optical detector at said predetermined position such that said first, second and third detector are active when a properly cut said inner liner for a group of cigarettes in a cigarette packaging machine is positioned under said detectors;

said first and second optical detector operably connected to an evaluation unit which is provided with a signal representing the conveying speed of said inner liner.

* * * * *